US008915185B2

(12) United States Patent
Pantchev

(10) Patent No.: US 8,915,185 B2
(45) Date of Patent: Dec. 23, 2014

(54) ASSEMBLY FOR AXIALLY ALIGNING A PRINT DIE

(75) Inventor: George Pantchev, Newton, KS (US)

(73) Assignee: Bunting Magnetics Co., Newton, KS (US)

( * ) Notice: Subject to any disclaimer, the term of this patent is extended or adjusted under 35 U.S.C. 154(b) by 52 days.

(21) Appl. No.: 13/604,292

(22) Filed: Sep. 5, 2012

(65) Prior Publication Data

US 2014/0060354 A1 Mar. 6, 2014

(51) Int. Cl.
*B41F 27/00* (2006.01)

(52) U.S. Cl.
USPC ..... 101/389.1; 101/383

(58) Field of Classification Search
USPC ..... 101/389.1
See application file for complete search history.

(56) References Cited

U.S. PATENT DOCUMENTS 1,958,299 A * 5/1934 Ericksson ..... 101/375
2,977,167 A * 3/1961 Barnhart ..... 92/82
2,982,207 A * 5/1961 Stromme ..... 101/395
2,987,994 A * 6/1961 Allison ..... 101/375
3,215,205 A * 11/1965 Sizer ..... 166/120
3,739,722 A * 6/1973 Zottoli ..... 101/375
4,111,569 A 9/1978 Mengel
4,150,622 A * 4/1979 Stollenwerk et al. ..... 101/378
4,578,956 A * 4/1986 Young ..... 62/6
6,615,722 B2 9/2003 Alberstadt et al.
6,874,415 B2 4/2005 Hoffmann et al.
7,328,656 B2 * 2/2008 Jeurink ..... 101/389.1
2009/0199732 A1 8/2009 Beyersdorff
2012/0198979 A1 8/2012 Ohsawa

* cited by examiner

*Primary Examiner* — Anthony Nguyen
(74) *Attorney, Agent, or Firm* — Kenneth H. Jack; Davis & Jack, L.L.C.

(57) ABSTRACT

An assembly for axially aligning a print die, the assembly comprising an axle; at least a first expandable force ring receiving the axle; a roll having a circumferential outer surface and a hollow bore receiving the axle and the at least first expandable force ring; loading sleeves connected operatively to the axle for alternatively outwardly compressing the at least first expandable force ring against the roll's hollow bore, for resisting axial movement of the roll with respect to the axle, and for alternatively inwardly decompressing the at least first expandable force ring for permitting such axial movement; and print die mounting magnets fixedly attached to the roll's outer circumferential surface for attaching the print die to the roll.

12 Claims, 5 Drawing Sheets

ASSEMBLY FOR AXIALLY ALIGNING A PRINT DIE

FIELD OF THE INVENTION

This invention relates to printing and print machines. More particularly, this invention relates to journal or stub axle mounted print rolls.

BACKGROUND OF THE INVENTION

Print rolls which are mounted upon and are rotatably driven by cantilevering axles, journal axles, or stub axles, generally must be precisely axially positioned along and in relation to an adjacent and counter rolling transfer roller. Upon proper axially positioning, such print rolls typically must be securely held on the axle at such position.

Known mechanisms and assemblies for mounting and fixing a print roll upon a journal axle are typically excessively mechanically complex and cumbersome, and such known mechanisms tend to undesirably promote or result in inaccuracies in axial alignment of print rolls.

The instant inventive assembly for axially aligning a print die (and including a print roll component of the assembly which supports the die) solves or ameliorates problems discussed above by providing an axle and print roll combination which mechanically facilitates variable axial positioning of the print roll, and which securely axially fixes and alternatively releases the roll via easily accessed axially positioned jack screws actuators.

BRIEF SUMMARY OF THE INVENTION

A first structural component of the instant inventive assembly for axially aligning a print die comprises a journal or stub configured axle having a cantilevering axial end. Such axle preferably has a proximal or oppositely axial end which is adapted for mounting upon a rotary powered print machine which is capable of securely holding, supporting, and rotatably driving the axle.

A further structural component of the instant inventive assembly for axially aligning a print die comprises at least a first, and preferably first and second, expandable force rings. In the preferred embodiment, each expandable force ring is configured to present at at least one of its ends an annular and inwardly chamfered wedge, such end either being the ring's axial or the ring's oppositely axial end. Preferably both ring ends are inwardly chamfered, such chamfering making the ring's axial cross sectional shape appear as a pair of mirroring trapezoids wherein the long sides of the trapezoids are positioned radially outwardly. In the preferred embodiment, each expandable force ring receives and extends annularly about or annularly overlies the axle. Suitably, more than two of such expandable force rings may be incorporated within the mechanism.

A further structural component of the instant inventive assembly comprises a cylindrical print roll having a circumferential outer surface and having an axially extending hollow bore. In the preferred embodiment, the print roll's hollow bore nestingly receives both the axle and each of the expandable force rings through which the axle extends, the rings and axle effectively forming a quill and shaft combination.

Further structural components of the instant inventive assembly comprise loading means which are connected operatively to the axle. In the preferred embodiment, the loading means are adapted for alternatively radially outwardly driving and compressing each of the expandable force rings against the circumferential inner wall of the roll's hollow bore, such compression serving a function of frictionally resisting axial movement of the roll with respect to the axle. The loading means are preferably further adapted for alternatively inwardly decompressing the expandable force rings for a frictional release which permits sliding adjustments and readjustments of the position of the print roll upon the axle.

In the preferred embodiment of the instant invention, the loading means comprise a plurality of drive sleeves. Each drive sleeve, like the expandable force rings, preferably extends about and receives the axle in the manner of a quill and shaft combination, the sleeves effectively comprising seam divided segments of such combination's quill. Preferably, the drive sleeves are mounted along the axle in an alternating series with the expandable force rings, each expandable force ring being axially and oppositely axially bounded by a pair of drive sleeves. Where the axial and oppositely axial ends of the expandable force rings are, as is preferred, inwardly chamfered, mating axial and oppositely axial ends of the drive sleeves are preferably outwardly chamfered at matching angles for wedge actuating engagements with the expandable force rings' ends.

In operation of the assembly, axially directed mechanical compression of the drive sleeves' ends against the expandable force rings' ends is translated via the mating chamfers into radially outward flexion forces which tend to expand the expandable force rings. Such force translation advantageously drives the rings' outer circumferential surfaces against the wall of the roll's bore, producing roll holding static friction between the expandable force rings and the bore wall.

In a preferred embodiment, the loading means further comprise a jack screw actuator which is fixedly attached to the axle's axial end, and which is adapted for providing the above described axially directed mechanical compression. Also in the preferred embodiment, the jack screw actuator directly drives against the axial end an axial-most positioned drive sleeve, the oppositely axial-most drive sleeve being stopped by an oppositely axially positioned stop flange or step presented upon the axle.

In operation of the instant invention, and assuming that the preferred jack screw actuated loading means are provided, the jack screw may be turned so that the loading means applies either slight pressure or no pressure against the axial and oppositely axial ends of loading means' drive sleeves. Upon such pressure minimization, the expandable force rings elastically return to their normal resting state without exerting any radially outward frictional pressure against the inner wall of the print roll's bore. Accordingly, upon such releasing actuation of the invention's loading means, an operator may easily slidably position the print roll in axial and circumferential directions with respect to the axle.

Upon reaching a desired circumferential and axial position of the print roll upon the axle, the invention's preferred jack screw actuated loading means may be oppositely turned to axially compress the chamfered ends of the loading means' drive sleeves against the matching oppositely chamfered ends of the expandable force rings. Such compression drives the circumferential outer surfaces of the expandable force rings into contact with the circumferential inner surface of the bore of the print roll. Such radially outwardly directed pressure produces a high level of static friction between surfaces, and effectively locks the print roll at the desired position upon the axle.

In a preferred embodiment of the instant invention, the loading means' jack screw actuator is specially configured to present and support axial positioning means, such means preferably also being jack screw actuated. Similarly with the jack screw actuated loading means, such second jack screw actuated axial positioning means are advantageously presented for manipulation at the axial end of the mechanism for precise axial positioning of the roll prior to operation of the loading means for mechanically locking the roll upon the axle.

The instant inventive assembly preferably further comprises print die mounting means which are fixedly attached to the rolls' outer circumferential surface, the print die mounting means preferably being adapted for securely attaching a print die to the roll's outer circumferential surface. In a preferred embodiment, the print die mounting means comprise a multiplicity of embedded magnets and para-magnetic steel pole pieces which create a circumferential magnetic field for securely holding a steel sheet printing die which is wrapped about the circumferential surface of the print roll. Suitably, the print die mounting means may alternatively comprise mechanical attachments or fasteners for holding such wrap-around print die. The print die mounting means may further alternatively comprise bold relief or negative print characters and images which are attached via whole formation with the outer circumferential surface of the print roll.

Accordingly, objects of the instant invention include provision of an assembly for axially aligning a print die which incorporates structures, as described above, and which arrange those structures in relation to each other in manners described above for the achievement of advantages and benefits, as described above.

Other and further objects, benefits, and advantages of the present invention will become known to those skilled in the art upon review of the Detailed Description which follows, and upon review of the appended drawings.

DETAILED DESCRIPTION OF A PREFERRED EMBODIMENT

Figure 1:
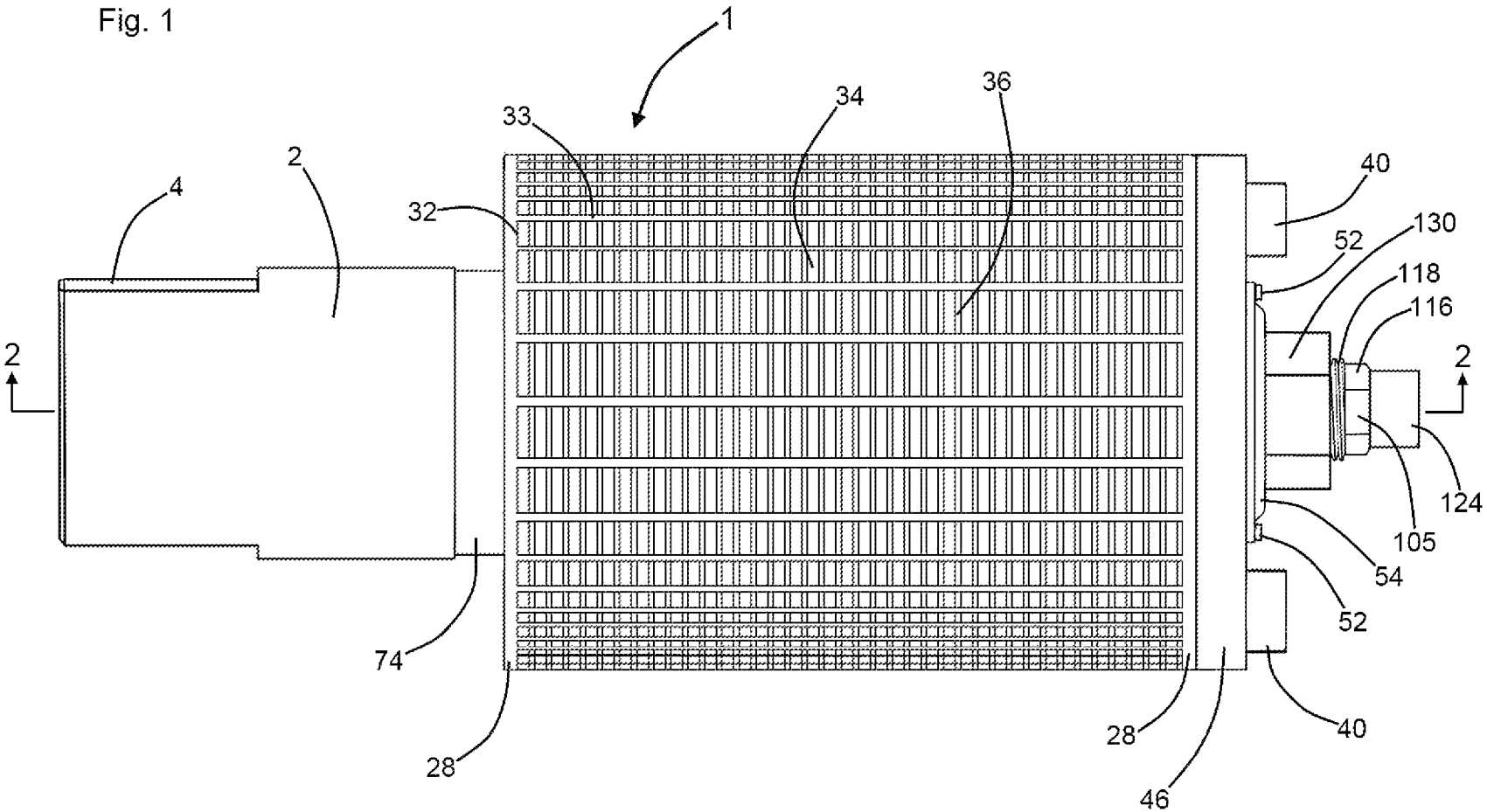
FIG. 1 is a side view of a preferred embodiment of the instant inventive assembly for axially aligning a print die.

Referring now to the drawings, and in particular to FIGS. 1-4, a preferred embodiment of the instant inventive assembly for axially aligning a print die is referred to generally by Reference Arrow 1. The assembly 1 comprises a journal axle 2, which incorporates printing machine mounting means in the form of flattened lands 4 presented at the axle's proximal or oppositely axial end. The distal or axial end 18 of the axle 2 preferably presents an axially opening socket 10, such socket having internal helical threads 12. A lubrication conduit 8 preferably interconnects the floor of socket 10 with the outer surface of the axle 2, and such axle's outer surface is preferably annularly coffered with steps or annular lands 6 and 14.

A cylindrical print roll 28 has a hollow and axially extending bore 30, such bore 30 preferably opening at the roll's axial and oppositely axial ends. In a preferred embodiment, the bore 30 of the print roll 28 includes axial and oppositely axial spacer sleeves 44 and 42, such sleeves preferably being fixedly attached to the inner wall of the bore 30, and having a precisely milled axle fitting inside diameter. In the preferred embodiment, the outer circumferential surface of the print roll 28 incorporates print die mounting means such as the depicted plurality of permanent magnet receiving channels 32,33. In a preferred embodiment, a multiplicity of permanent magnets and magnetic pole pieces 34 and 36 are mounted and embedded within channels 32,33, such magnets' poles preferably being arranged in a "NS,SN,NS,SN, NS . . . " polarity series with the polar axes parallel with the roll's axis. Such mounting means advantageously form a substantially continuous magnetic circumferential roll surface which is capable of securely holding a "wrap around" ferromagnetic printing die (not depicted within views). The depicted channels 32,33 and magnets 34,36 are intended as being representative of other suitably used die mounting means such as mechanical fasteners and wholly formed or etched print characters and images.

An axial end plate 46 is preferably fixedly and securely bolted to the axial end of the print roll 28 by means of bolts 40 which have Allen sockets 41 at their axial ends, and have helical threads 48 for engaging threaded sockets 38 within the roll 28. In the preferred embodiment, the end plate 46 has a central aperture 47 through which the invention's dual jack screw actuators assemblies (further discussed below) may axially end.

Figure 4:
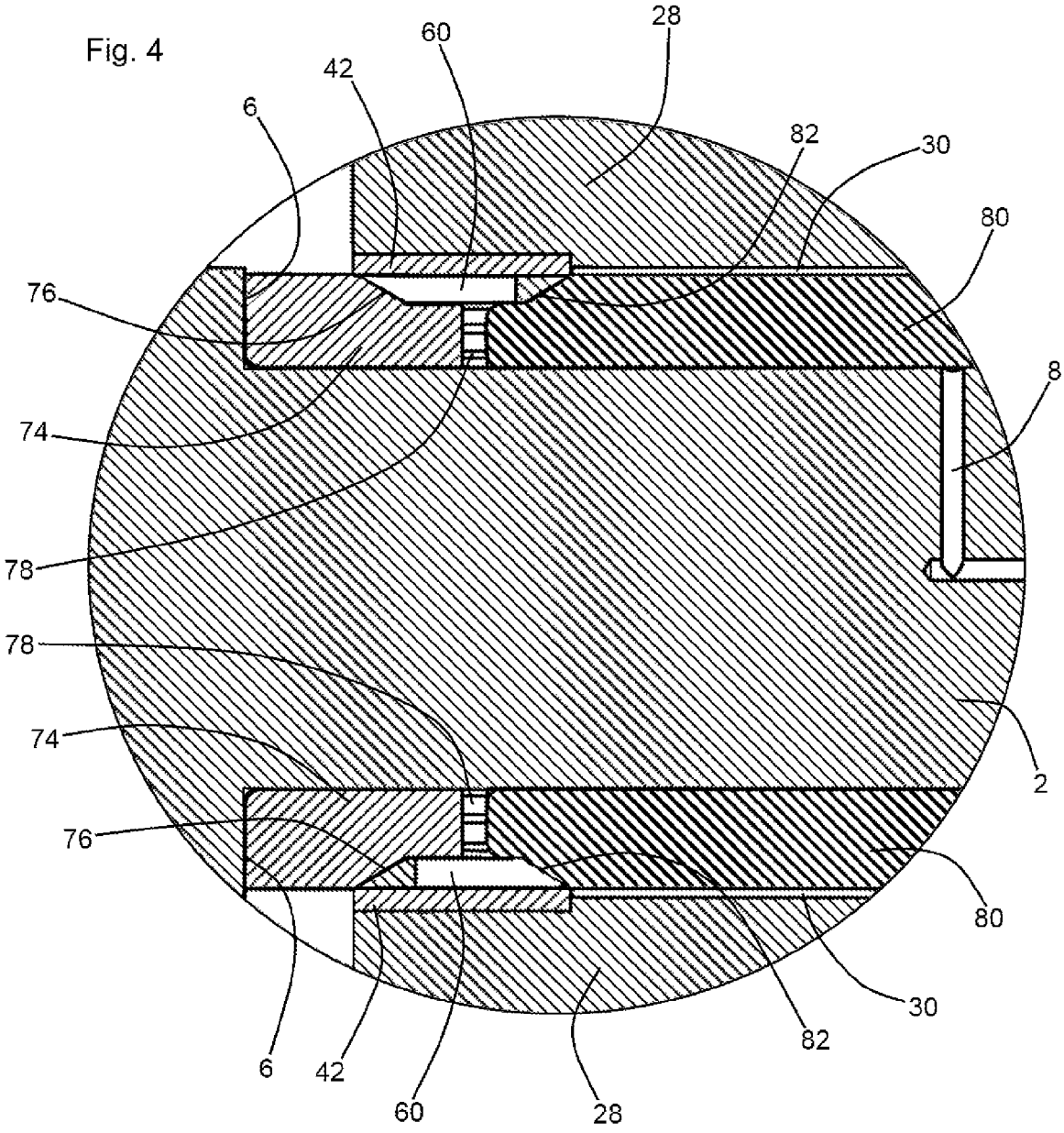
FIG. 4 is a magnified view of an alternative portion of the structure of FIG. 2, as indicated in FIG. 2.
Figure 5:
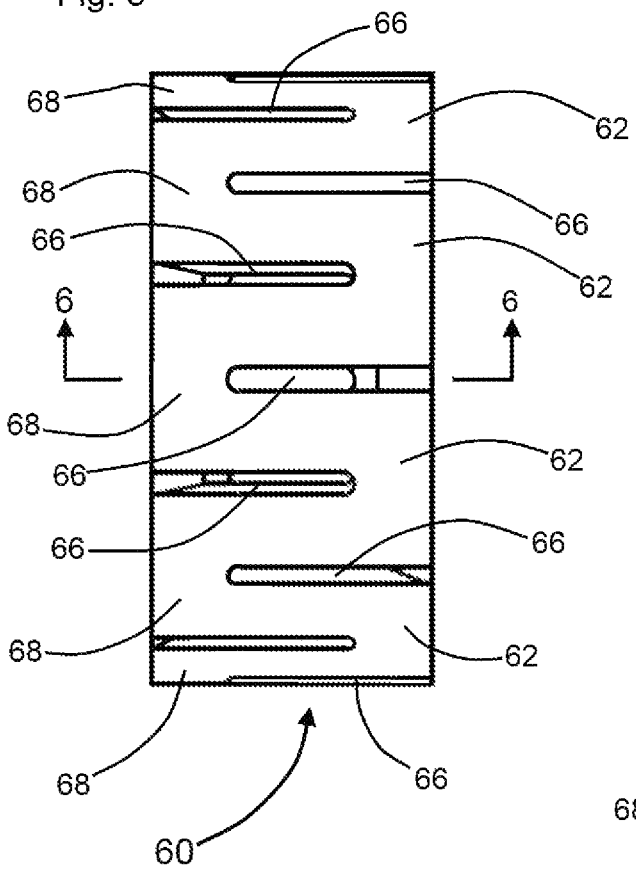
FIG. 5 is a side view of one of the invention's expandable force rings.
Figure 6:
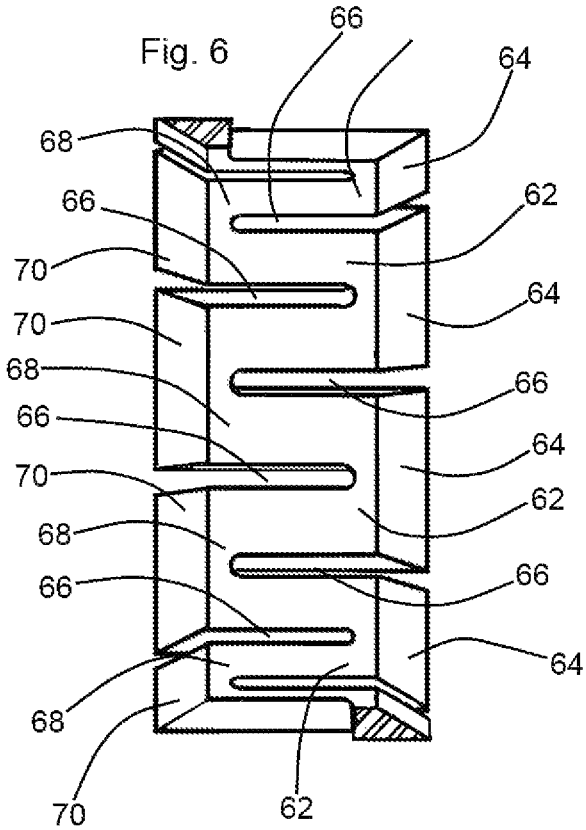
FIG. 6 is a sectional and interior view of the FIG. 5 ring as indicated in FIG. 5.

Referring in particular to FIGS. 4-6, the instant inventive assembly preferably comprises at least a first expandable force ring 60 having at least one inwardly chamfered face. Such ring's chamfered face may either be an axial face 64 or an oppositely axial face 70. However, in the preferred embodiment the axial and oppositely axial ends of the expandable force ring 60 each respectively present inwardly chamfered faces 64 and 70.

Referring to FIGS. 5 and 6, an annular array of expansion resistance relieving slots 66 are milled within the ring 60, such relief slots 66 preferably alternatingly extending from the ring's axial and oppositely axial ends. Such alternating extensions of relief slots 66 advantageously form an annular and alternating series of axially extending wedge arms 62 and oppositely axially extending wedge arms 68. By configuring the at least first expandable force ring 60 to include such oppositely extending wedge arms 62 and 68, such ring is easily mechanically outwardly expanded for compression against the bore of the print roll, and such ring consistently, flexibly withdraws from such compressive contact upon release of axially directed wedge driving forces.

Figure 2:
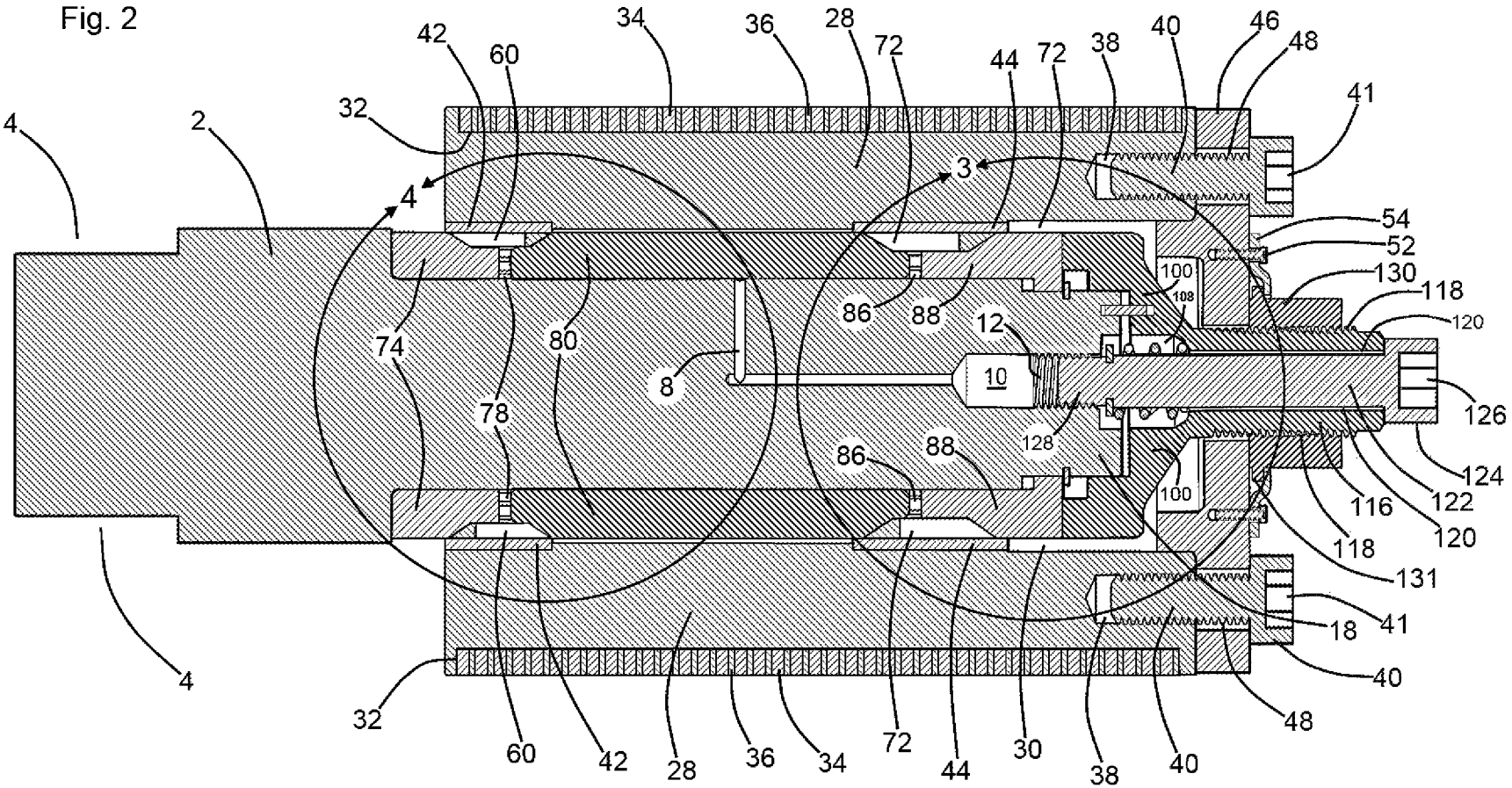
FIG. 2 is a sectional view, as indicated in FIG. 1.

As indicated in FIGS. 2 and 4, the at least first expandable force ring 60 extends about and receives axle 2. A second similarly configured (though not identically configured, as explained below) expandable force ring 72 is preferably provided, such second ring 72 being positioned axially from expandable force ring 60, and such ring similarly receiving axle 2.

Referring simultaneously to all figures, in order to drive the expandable force ring 60 against the inner bore wall of roll 28, and also to outwardly drive the preferably provided second ring 72, loading means are provided, such means preferably being connected operatively to the axle 2. In the preferred embodiment, the loading means comprise a plurality of drive sleeves 74, 80, and 88, such sleeves being fitted for receiving axle 2 in the manner of a quill and shaft combination. In the preferred embodiment, each of the outwardly chamfered faces 76, 82, 84, 90 at the ends of the drive sleeves 74, 80, and 88 mates with, and engages in a sliding wedge fashion, one of the inwardly chamfered faces 64 or 70 of one of the expandable force rings 60 or 72.

The loading means necessarily include means for compressing the drive sleeves 74, 80, and 88 together beneath the expandable force rings 60 and 72 to cause their mating inclined plane configured ends to function as outwardly expanding wedge members, such members frictionally contacting and holding the roll 68 upon the axle 2. In the depicted preferred embodiment, the loading means comprise a first jack screw actuator assembly which includes a helically threaded socket 10,12 a bolt 122 having mating helical threads 128 at its oppositely axial end, such bolt having an Allen wrench socket 126 within its axial head 124. Such loading means' jack screw actuator preferably further comprises a cap 100 having a hollow bore or aperture 120 through which the bolt 122 may oppositely axially extend. Such jack screw actuator functions in combination with axle 2 as a clamp or vice, with a coffered land 6 at the oppositely axial end of axle 2 serving as an oppositely axial vice jaw and with the base of the bolt head 124 serving as an axial vice jaw. Wrench actuated clockwise turning of bolt 122 within helically threaded socket 10,12 draws the cap 100 oppositely axially against the axial end of the axial-most drive sleeve 88, driving such sleeve against the second expandable force ring 72. Such clamping force in sequence drives ring 72 against a medial drive sleeve 80, and drives such sleeve against the oppositely axial or first expandable force ring 60. Substantially simultaneously, the expandable force ring 60 is driven against the oppositely axial-most drive sleeve 74 whose oppositely axial motion is stopped by the axle's land 6. Clearance gaps 78, 86, and 16 between the segments of the quill are preferably provided so that the oppositely axially directed compressive force applied by the jack screw exclusively translates from quill segment to quill segment at the expandable force rings' and drive sleeves' inwardly and outwardly chamfered faces. By concentrating such forces at the assembly's chamfered faces, the jack screw actuator's clamping action effectively drives the outer circumferential surfaces of the expandable force rings 60 and 72 outwardly against the roll 28, and securely clamps the roll 28 at a selected position upon axle 2.

Figure 3:
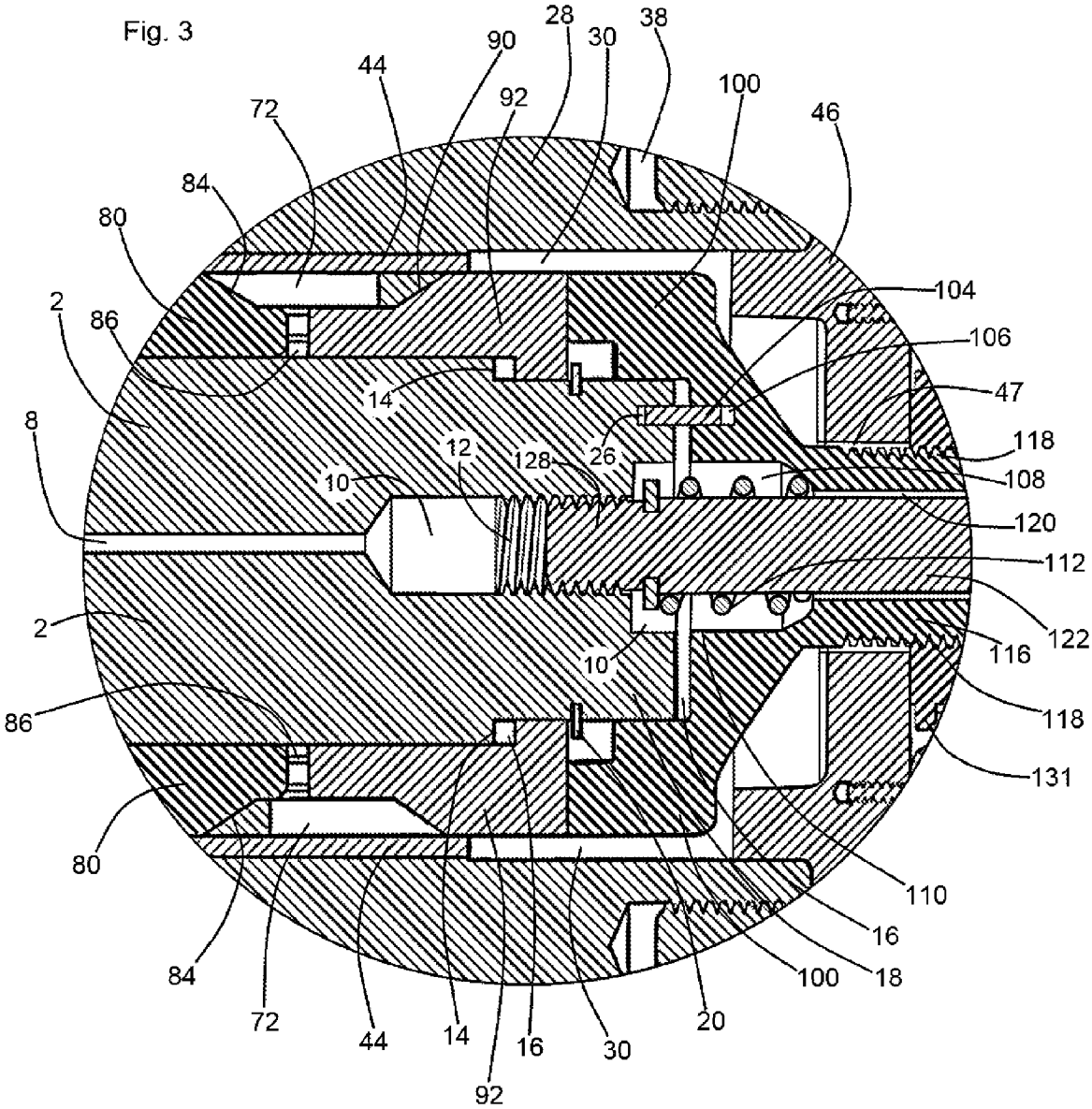
FIG. 3 is a magnified view of a portion of the structure of FIG. 2, as indicated in FIG. 2.

Referring simultaneously to FIGS. 1, 2, and 3, in order to allow bolt 122 to be turned by an Allen wrench without co-rotating cap 100, the cap's axially extending crown 116 preferably presents wrench jaw lands 105, such lands 105 allowing a second wrench to apply counter torque. In order to alternatively provide such counter-torque a combination of alignable sockets 26 and 106, and a rotation stopping pin 104 preferably mechanically links the axle 2 with the cap 100, such combination stopping rotary movement of cap 100 with respect to axle 2 while allowing axial movement.

Referring simultaneously to FIGS. 2 and 3, a retention clip 20 which engages the axial end 18 of axle 2 is preferably provided for retaining the drive sleeve and expandable force ring quill segments upon the axle 2 in the event of a disassembly of the loading means' jack screw assembly. Additionally, a spring 112, spring void 108, and spring retaining clip 110 combination is provided to retain bolt 112 in position for threaded engagement upon extension of the cap 110 over the axial end 18 of axle 2.

Referring simultaneously to FIGS. 2 and 3, positioning means are preferably provided for, upon loosenings and inward releases of the expandable force rings 60 and 72, precisely axially locating the print roll 28 upon the axle 2. A preferred embodiment of such axial positioning means comprises the cap's axially extending crown 116. Such crown 166 preferably has helical threads 118 which are engaged by a helically threaded nut 130. Provided that the expandable force rings 60 and 72 are decompressed, clockwise turning of nut 130 may advantageously drive plate 46 and the attached print roll 28 oppositely axially along the axle 2. In order to allow counter-clockwise turning of nut 130 to axially reposition the roll 28, the nut 130 preferably presents an annular flange 131 which may engage a catch ring 154 which is mounted to the axial surface of the end plate 46 by means of mounting screws 52.

Referring to FIG. 2, it may be seen that the inside diameter of expandable force ring 72 is less than that of ring 60, such diameter differential causing ring 72 to be stiffer than ring 60. Such stiffness differential advantageously requires that ring 72 outwardly elastically deform slightly subsequently to the outward deformation of ring 60. Alternatively such elastic deformation sequence may be achieved by composing ring 72 of a material having a modulus of elasticity greater than that of ring 60. For example, ring 60 may be made of brass and ring 72 may be dimensionally identical but made of steel. Such arrangements of the rings 60 and 72 to cause ring 60 to outwardly deform before the outward deformation of ring 72 advantageously assures that the outward frictional clamping force exerted by ring 72 will not mechanically interrupt the clamping function of ring 60.

In use of the instant inventive assembly for axially aligning a print die, an operator may easily and conveniently axially position and reposition the print roll 28 upon the axle 2, and may securely lock the print roll 28 at a desired position by means of selective engagements of wrenches with nut 130 and with bolt 122.

While the principles of the invention have been made clear in the above illustrative embodiment, those skilled in the art may make modifications in the structure, arrangement, portions, and components of the invention without departing from those principles. Accordingly, it is intended that the description and drawings be interpreted as illustrative and not in the limiting sense, and that the invention be given a scope commensurate with the appended claims.

The invention hereby claimed is:

1. An assembly for axially aligning a print die, the assembly comprising:

(a) an axle;

(b) first and second expandable force rings, said rings receiving the axle;

(c) a roll having a circumferential outer surface and a hollow bore, said bore receiving the axle and the first and second expandable force rings;

(d) loading means connected operatively to the axle, the loading means being adapted for outwardly compressing the first and second expandable force rings against the roll's hollow bore for resisting movement of the roll with respect to the axle, and alternatively for inwardly decompressing the first and second expandable force rings from the roll's hollow bore for permitting such movement, the loading means comprising a plurality of drive sleeves mounted over the axle, the drive sleeves being arranged therealong in an alternating series with the expandable force rings; and (e) print die mounting means fixedly attached to the roll's outer circumferential surface, the print die mounting means being adapted for attaching the print die to the roll's outer circumferential surface, wherein the drive sleeves have axial and oppositely axial ends, said ends having beveled outer surfaces for wedge actuating engagements with the expandable force rings' beveled inner surfaces.

2. The assembly for axially aligning a print die of claim 1 wherein each ring among the at least first and second expandable force rings has an inside diameter, the second expandable force ring's inside diameter being less than that of the at least first expandable force ring, and wherein the second expandable force ring is positioned axially from the at least first expandable force ring.

3. The assembly for axially aligning a print die of claim 1 wherein each ring among the at least first and second expandable force rings has a modulus of elasticity, the second expandable force ring's modulus of elasticity being greater than that of the at least first expandable force ring, and wherein the second expandable force ring is positioned axially from the at least first expandable force ring.

4. The assembly for axially aligning a print die of claim 1 wherein the loading means comprise a first jack screw actuator, said actuator operatively spanning between the axle and an axial most sleeve among the plurality of drive sleeves.

5. The assembly for axially aligning a print die of claim 4 wherein the axle has an axial end, and wherein the first jack screw actuator comprises a helically threaded socket, said socket opening axially at the axle's axial end.

6. The assembly for axially aligning a print die of claim 5 wherein the first jack screw actuator comprises a cap and bolt combination, the cap being apertured and slidably receiving the axle's axial end, and the bolt being helically threaded and extending through the aperture for engagement with the axle's helically threaded socket.

7. The assembly for axially aligning a print die of claim 6 further comprising axial positioning means operatively spanning between the cap and the roll, the axial positioning means being adapted for, upon decompressing the loading means, oppositely axially moving the roll.

8. The assembly for axially aligning a print die of claim 7 wherein the axial positioning means comprise a second jack screw actuator.

9. The assembly for axially aligning a print die of claim 8 wherein the apertured cap has an axially extending crown having a helically threaded outer circumferential surface, and wherein the second jack screw actuator comprises said surface.

10. The assembly for axially aligning a print die of claim 9 wherein the axial positioning means are further adapted for alternatively axially moving the roll.

11. The assembly for axially aligning a print die of claim 10 wherein the axial positioning means comprise an internally helically threaded nut, said nut threadedly engaging the cap's axially extending crown.

12. The assembly for axially aligning a print die of claim 11 wherein the print die mounting means comprise a multiplicity of permanent magnets, each magnet among the multiplicity of permanent magnets being embedded within the roll's outer circumferential surface.

* * * * *